US008651002B2

(12) United States Patent
Sato

(10) Patent No.: US 8,651,002 B2
(45) Date of Patent: Feb. 18, 2014

(54) SHEET CUTTER

(75) Inventor: Hitoshi Sato, Yamanashi (JP)

(73) Assignee: Nippon Primex Inc., Tokyo (JP)

( * ) Notice: Subject to any disclaimer, the term of this patent is extended or adjusted under 35 U.S.C. 154(b) by 255 days.

(21) Appl. No.: 12/440,834

(22) PCT Filed: Sep. 10, 2007

(86) PCT No.: PCT/JP2007/000984

§ 371 (c)(1),
(2), (4) Date: Mar. 11, 2009

(87) PCT Pub. No.: WO2008/032444

PCT Pub. Date: Mar. 20, 2008

(65) Prior Publication Data

US 2010/0043617 A1 Feb. 25, 2010

(30) Foreign Application Priority Data

Sep. 12, 2006 (JP) ..... 2006-247414

(51) Int. Cl.

| | |
|---|---|
| ***B26D 1/00*** | (2006.01) |
| ***B26D 5/08*** | (2006.01) |
| ***B27B 3/00*** | (2006.01) |
| ***B27B 13/00*** | (2006.01) |
| ***B26D 5/20*** | (2006.01) |

(52) U.S. Cl.

USPC ..... 83/582; 83/828; 83/694; 83/611; 83/823

(58) Field of Classification Search

USPC ..... 83/202, 236, 242, 582, 602, 611, 628, 83/629, 636, 694, 697, 821, 823, 827, 828

See application file for complete search history.

(56) References Cited

U.S. PATENT DOCUMENTS

| | | | | | |
|---|---|---|---|---|---|
| 307,678 | A | * | 11/1884 | Parish | 83/404.4 |
| 525,871 | A | * | 9/1894 | Stimpson | 74/44 |
| 635,457 | A | * | 10/1899 | Yandall | 83/582 |
| 1,585,543 | A | * | 5/1926 | Horold | 83/751 |
| 1,925,848 | A | * | 9/1933 | Rubin | 83/713 |
| 2,487,322 | A | * | 11/1949 | Eriksson | 30/384 |
| 2,672,930 | A | * | 3/1954 | Iffland | 83/372 |
| 2,860,014 | A | * | 11/1958 | Short | 384/53 |
| 3,196,724 | A | * | 7/1965 | Frank | 83/349 |
| 3,690,531 | A | * | 9/1972 | Tanigami | 226/136 |

(Continued)

FOREIGN PATENT DOCUMENTS

| | | |
|---|---|---|
| JP | 6-182696 | 7/1994 |
| JP | 7-11907 | 3/1995 |

(Continued)

*Primary Examiner* — Kenneth E. Peterson
*Assistant Examiner* — Samuel A Davies
(74) *Attorney, Agent, or Firm* — Drinker Biddle & Reath LLP

(57) ABSTRACT

A sheet cutter includes: a stationary knife including a straight blade part formed in a straight-line shape in a longitudinal direction; a movable knife including a cutting edge part formed in the shape of V-character, opposed to mesh with the straight blade part of the stationary knife, the movable knife being able to freely move toward or back from the stationary knife; a movable knife pressing member for pressing the movable knife against the stationary knife; and a movable knife driver driving the movable knife forward or backward. The movable knife pressing member pressure contacts the movable knife against the stationary knife by a compression coil spring contained inside the movable knife pressing member.

3 Claims, 4 Drawing Sheets

(56) References Cited

U.S. PATENT DOCUMENTS

| | | | | | |
|---|---|---|---|---|---|
| 4,149,458 | A * | 4/1979 | Clary | 101/93.07 |
| 4,936,177 | A * | 6/1990 | Ozawa et al. | 83/582 |
| 5,000,070 | A * | 3/1991 | Ozawa et al. | 83/582 |
| 5,195,413 | A * | 3/1993 | Johnson | 83/132 |
| 5,237,901 | A * | 8/1993 | Warga, III | 83/583 |
| 5,463,920 | A * | 11/1995 | Korb | 83/56 |
| 5,482,389 | A * | 1/1996 | Bickoff et al. | 400/621 |
| 5,647,261 | A * | 7/1997 | Wierenga | 83/649 |
| 5,647,262 | A * | 7/1997 | Webel | 83/823 |
| 5,749,277 | A * | 5/1998 | Walker | 83/563 |
| 5,833,380 | A * | 11/1998 | Hosomi et al. | 400/621 |
| 5,974,930 | A * | 11/1999 | Longrod | 83/629 |
| 6,067,886 | A * | 5/2000 | Irwin | 83/615 |
| 6,109,154 | A * | 8/2000 | Miyatsu et al. | 83/627 |
| 6,152,007 | A * | 11/2000 | Sato | 83/582 |
| 6,155,731 | A * | 12/2000 | Bertalan et al. | 400/621 |
| 6,361,231 | B1 * | 3/2002 | Sato et al. | 400/621 |
| 6,405,625 | B1 * | 6/2002 | Nomura et al. | 83/618 |
| 6,508,600 | B1 * | 1/2003 | Nonaka | 400/621 |
| 6,749,352 | B2 * | 6/2004 | Yamada et al. | 400/593 |
| 6,793,423 | B1 * | 9/2004 | Saito et al. | 400/621 |
| 6,793,424 | B2 * | 9/2004 | Yamada et al. | 400/621 |
| 6,860,184 | B1 * | 3/2005 | Chen et al. | 83/582 |
| 6,988,843 | B2 * | 1/2006 | Song | 400/621 |
| 7,001,089 | B2 * | 2/2006 | Tozaki et al. | 400/708 |
| 7,191,635 | B2 * | 3/2007 | Chun et al. | 72/452.9 |
| 7,267,500 | B2 * | 9/2007 | Tsuchiya et al. | 400/621 |
| 7,392,731 | B2 * | 7/2008 | Nonaka | 83/694 |
| 7,731,437 | B2 * | 6/2010 | Shirotori et al. | 400/621 |
| 7,876,346 | B2 * | 1/2011 | Watanabe et al. | 347/222 |
| 2002/0056354 | A1 * | 5/2002 | Morita et al. | 83/564 |
| 2003/0172792 | A1 * | 9/2003 | Imai | 83/694 |
| 2004/0172931 | A1 * | 9/2004 | Kolb et al. | 56/249 |
| 2007/0199422 | A1 * | 8/2007 | Kawaguchi | 83/583 |
| 2010/0086340 | A1 * | 4/2010 | Takami | 400/621 |

FOREIGN PATENT DOCUMENTS

| | | | | |
|---|---|---|---|---|
| JP | 8-5030 | | 1/1996 | |
| JP | 8-22517 | | 3/1996 | |
| JP | 8-197485 | | 8/1996 | |
| JP | 10-315184 | | 12/1998 | |
| JP | 2002-254386 | | 9/2002 | |
| JP | 2003-136473 | | 5/2003 | |
| JP | 2003266366 | A * | 9/2003 | B26D 1/08 |
| JP | 2004351539 | A * | 12/2004 | B26D 1/08 |
| JP | 3127201 | | 11/2006 | |

* cited by examiner

SHEET CUTTER

TECHNICAL FIELD

The present invention relates to a structure of a sheet cutter for cutting the sheet such as paper or plastic film in various printers or ticket dispensers.

BACKGROUND ART

The related-art sheet cutter for cutting the sheet using a stationary knife and a movable knife had a structure of cutting the sheet between the stationary knife and the movable knife by pressing and urging the entire movable knife to the stationary knife by means of a pressing welding spring to make the stationary knife and the movable knife mesh with each other while making a tip of a cutting edge part of the movable knife contact with the stationary knife. For example, there are sheet cutters as described in JP-B-8-22517 (refer to patent document 1), JP-B-7-11907U (refer to patent document 2), and JP-B-8-5030 (refer to patent document 3).

In the related-art example as described in JP-B-8-22517 (refer to patent document 1), since the stationary knife or the movable knife is formed in the convex shape, if one tries to form the knife in the optimal shape and accurately, the cost of working is increased, or if one tries to form the knife at low cost, the knife can not be formed in the optimal shape and accurately.

Also, there was a problem that if the cutting edge is not formed in the optimal shape and accurately to produce a gap between both knives, the sheet is plucked, when cut away, to produce unclean cut section, or if there is any interference or the pressing force s too high, a drive load of the movable knife on the motor is increased, and the abrasion of knife is severer.

Thus, the present inventor has offered a sheet cutter comprising a stationary knife including a straight blade part formed like the straight line in the longitudinal direction, a movable knife, including a cutting edge part formed on the slant oppositely to mesh on a meshing plane with the straight blade part of the stationary knife, that can freely move toward or back from the stationary knife, a movable knife pressing member for pressing the movable knife to the stationary knife, and movable knife driver driving the movable knife forward or backward, wherein the movable knife is provided with a protrusion near the cutting edge part on the back of the meshing plane, the movable knife pressing member is provided with a pressing end portion near the straight blade part of the stationary knife, and the pressing end portion presses the protrusion to press the movable knife against the stationary knife in a state where the meshing plane is inclined in a direction where the tip recedes from the opposed surface of the stationary knife, as shown in JP-A-10-315184 (refer to patent document 4).

Patent document 1: JP-B-8-22517
Patent document 2: JP-B-7-11907U
Patent document 3: JP-B-8-5030
Patent document 4: JP-A-10-315184

DISCLOSURE OF THE INVENTION

In JP-A-10-315184 (refer to patent document 4), the movable knife can freely move toward or back from the stationary knife, and is provided with the protrusion near the cutting edge part on the back of the meshing plane. The movable knife presswelding member composed of a leaf spring is provided with the pressing end portion near the straight blade part of the stationary knife, whereby said pressing end portion presses the protrusion to pressure weld the movable knife against the stationary knife, as described above.

However, since the movable knife pressing member composed of the leaf spring presses the movable knife against the stationary knife, the position of holding the movable knife pressing member must be kept away a certain distance from the movable knife to secure a movable range of the lead spring, resulting in a problem that the thickness of the portion is reduced.

Also, there was a problem that the spring pressure of the leaf spring is unbalanced along the width direction, it is difficult to apply a uniform load necessary to press the movable knife against the stationary knife, so that the sheet is plucked, when cut away, to produce unclean cut section, or the pressing force is so high that a drive load of the movable knife on the motor is increased, and the abrasion of knife is partially severe.

The present invention provides a sheet cutter that can cut the sheet cleanly without being left uncut or torn off in cutting the sheet and is cheap and very compact by reducing the thickness of the movable knife pressing member.

According to a first aspect of the invention, a sheet cutter is provided with a stationary knife including a straight blade part formed like the straight line in the longitudinal direction, a movable knife including a cutting edge part formed in the shape of V-character, opposed to mesh with the straight blade part of the stationary knife, the movable knife being able to freely move toward or back from the stationary knife, a movable knife pressing member for pressing the movable knife against the stationary knife, and movable knife driver driving the movable knife forward or backward. The movable knife pressing member pressure welds the movable knife against the stationary knife by means of a compression coil spring contained inside the movable knife pressing member.

According to a second aspect of the invention, the movable knife pressing member may be adjacent to the sheet to be cut and also serves as a guide for the sheet.

According to a third aspect of the invention, the movable knife pressing member may be a wear resistant plastic molding.

The sheet cutter comprises the stationary knife including the straight blade part formed like the straight line in the longitudinal direction, the movable knife including the cutting edge part formed in the shape of V-character, opposed to mesh with the straight blade part of the stationary knife, the movable knife being able to freely move toward or back from the stationary knife, the movable knife pressing member for pressing the movable knife against the stationary knife, and movable knife driver driving the movable knife forward or backward. The movable knife pressing member presses the movable knife against the stationary knife by means of the compression coil spring contained inside the movable knife pressing member. The movable knife is pressed welded in the direction to the stationary knife at a position very close to a meshing point between the cutting edge part of the movable knife and the straight blade part of the stationary knife. Thereby, the cutting edge part can be pressed at the meshing point against the straight blade part with a great force, so that the sheet can be cut with a clean section without pluck or cutting fault.

Also, since the movable knife can be pressed against the stationary knife in a smaller movable range than the movable range required for the leaf spring, it is possible to provide the sheet cutter that is very compact by reducing the thickness of the movable knife pressing member.

DESCRIPTION OF REFERENCE NUMERALS

Figure 1:
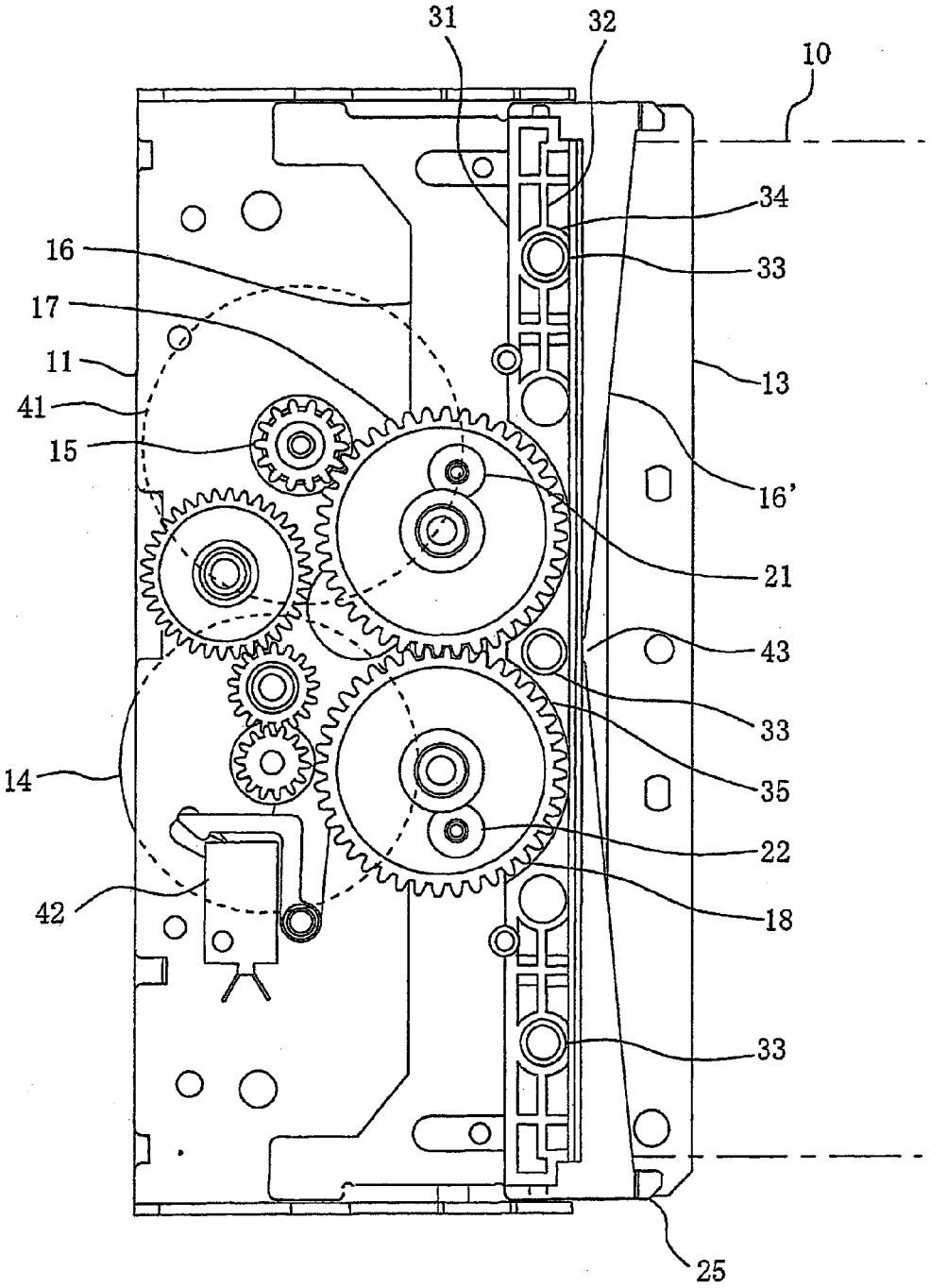
FIG. 1 is a plan view showing one exemplary embodiment of a sheet cutter according to the present invention.

11: housing bottom plate
12: sheet insertion opening
13: stationary knife
14: motor
15: driving gear
16: movable knife
16': cutting edge part
17: first movable knife driving gear
18: second movable knife driving gear
19, 20: rotation shaft
21, 22: movable knife driving pin
23, 24: driving groove
25: movable knife guide portion
26: housing top
31: movable knife pressing member
32: stiffening rib
33: coil spring receiving portion
34: coil spring
35: notch
41: gear cover
42: home position detection sensor
43: uncut groove

BEST MODE FOR CARRYING OUT THE INVENTION

An exemplary embodiment of a sheet cutter according to the present invention will be described below with reference to the drawings.

Figure 2:
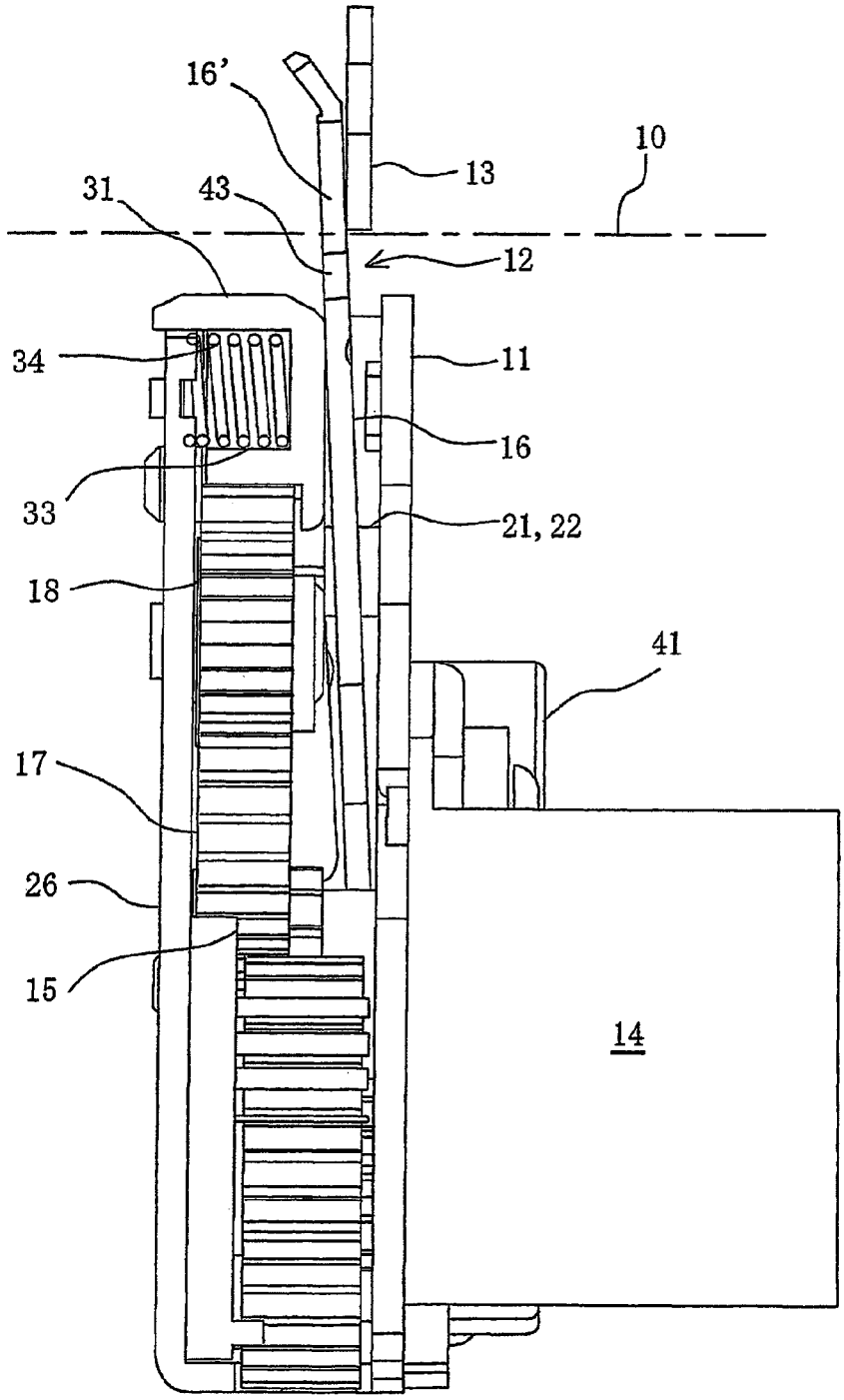
FIG. 2 is an enlarged side view thereof.
Figure 3:
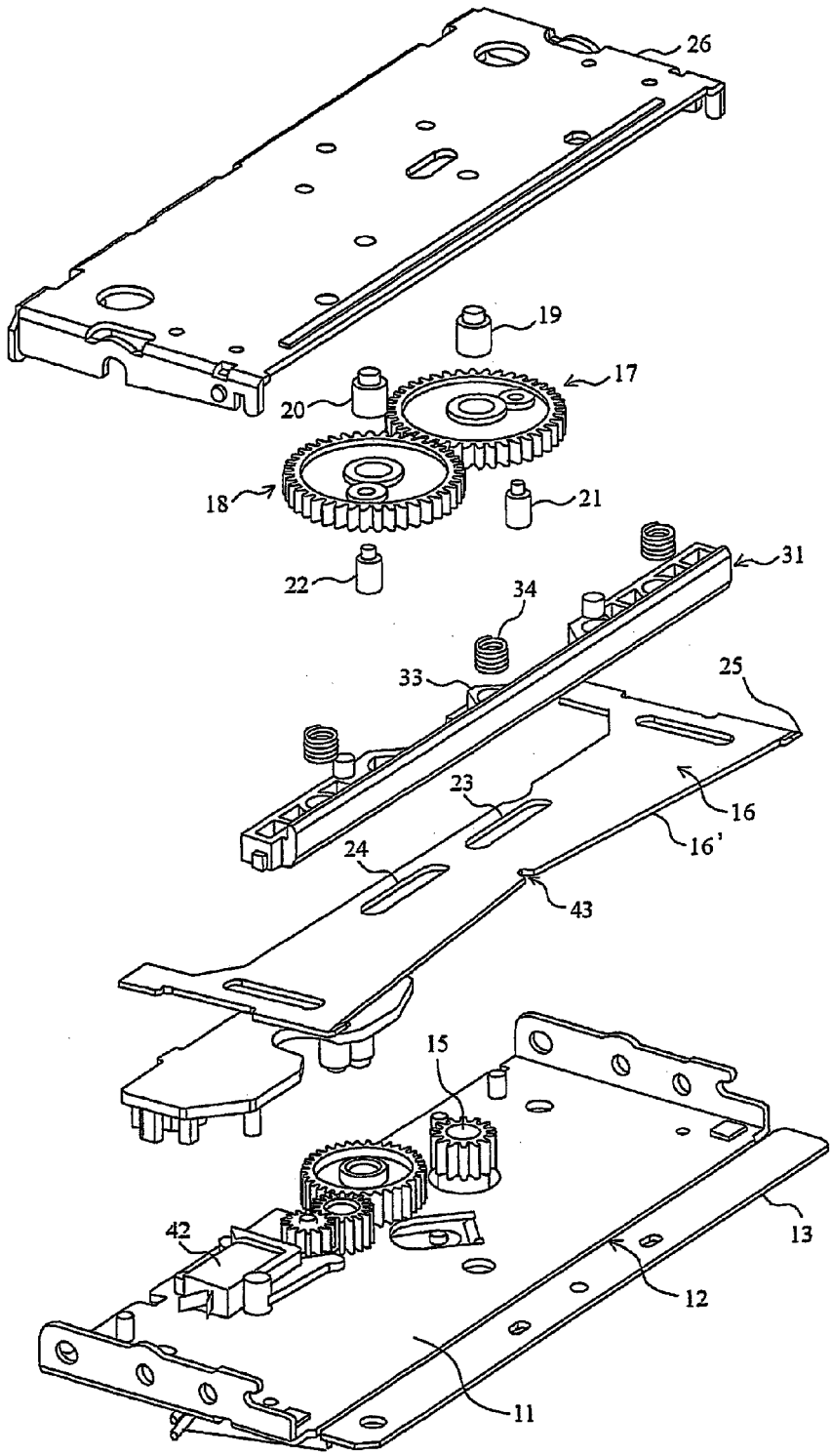
FIG. 3 is an exploded perspective view thereof.
Figure 4:
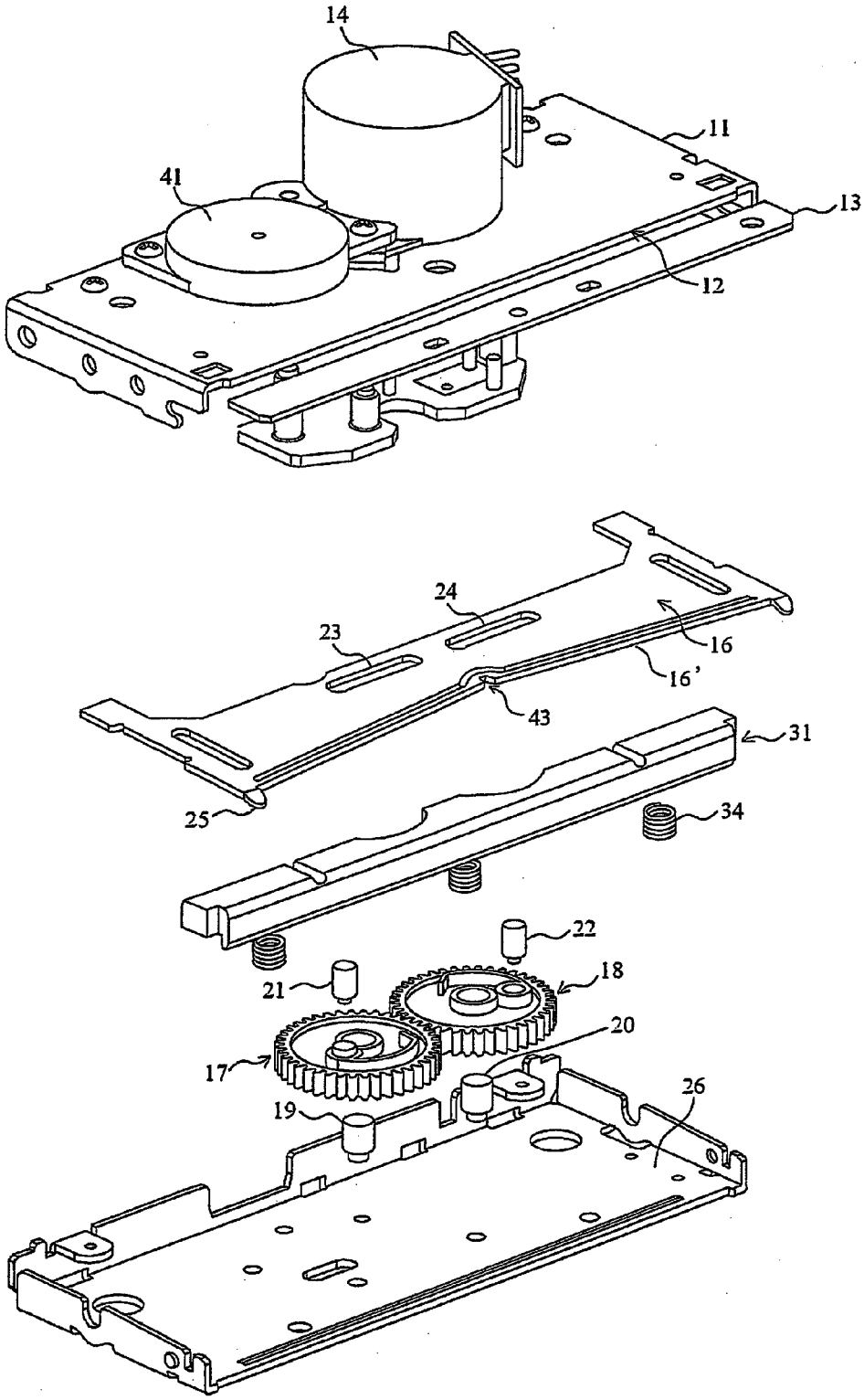
FIG. 4 is an exploded perspective view as seen from another direction.

FIG. 1 is a plan view showing an exemplary embodiment of a sheet cutter according to the invention. FIG. 2 is an enlarged side view thereof. FIG. 3 is an exploded perspective view thereof. FIG. 4 is an exploded perspective view as seen from another direction. The exemplary embodiment of the sheet cutter according to the invention will be described below using FIGS. 1 to 4.

In FIGS. 1 to 4, a stationary knife 13 is provided via a sheet insertion opening 12 on an end portion of a housing bottom plate 11. Also, a motor 14 is fixed on the lower surface of the housing bottom plate 11, and connected to a drive circuit (not shown). A driving gear 15 of the motor 14 disposed to protrude upward out of the housing bottom plate 11 meshes via a movable knife 16 with a first movable knife driving gear 17. Also, a second movable knife driving gear 18 is assembled to mesh with the first movable knife driving gear 17. And the first movable knife driving gear 17 and the second movable knife driving gear 18 are rotated along with the rotation of the motor 14.

In the drawings, the rotation shafts 19 and 20 are attached to a housing top plate 26, around which the first movable knife driving gear 17 and the second movable knife driving gear 18 are rotatably attached. Also, the movable knife driving pins 21 and 22 are fitted into a pair of driving grooves 23 and 24 formed like the straight line along the width direction of the movable knife 16. Accordingly, if the first movable knife driving gear 17 and the second movable knife driving gear 18 are rotated along with the rotation of the motor 14, the movable knife driving pins 21 and 22 revolved accordingly engage the driving grooves 23 and 24 to move the movable knife 16 toward or back from the stationary knife 13.

The above is movable knife driver mechanism.

Referring to FIG. 2, the reciprocal relation between the stationary knife 13 and the movable knife 16 will be described below in detail. The movable knife 16 has movable knife guide portions 25 at both ends. Each movable knife guide portion 25 contacts the stationary knife 13, and is formed to project so that the movable knife 16 does not get rid of contact with the stationary knife 13 even in a state where the movable knife 16 is moved back. Between the movable knife guide portions 25 formed at both ends in the width direction, a cutting edge part 16' is formed in the shape of V-character in which a central part is retracted from the stationary knife 13 and two oblique lines are combined for the straight stationary knife 13. The reason why the cutting edge part 16' is oblique is to efficiently cut the sheet 10 owing to scissoring effect by the cutting edge part 16' of the movable knife 16 made oblique to the straight stationary knife 13.

A movable knife pressing member 31 is held between the movable knife 16 disposed in contact with the stationary knife 13 on the housing bottom plate 11 and the housing top 26. The movable knife pressing member 31 is formed from a wear resistant plastic molding, and disposed like the straight line in the same direction as the straight stationary knife 13.

That is, examples of the wear resistant plastic molding element composing the movable knife pressing member 31 are preferably engineering plastics, such as polyamide (PA), polyacetal (POM), polycarbonate (PC), polybutylene terephthalate (PBT), denatured polyphenylene oxide (denatured PPO/PPE), polyphenylene sulfide (PPS), polysulfone (PSU), polyether sulfone (PES), and polyether ether ketone (PEEK). Such a wear resistant plastic molding element is molded like a slat on a pressing end surface of the movable knife pressing member 31 and to be concave on the opposite surface, as shown in FIGS. 1 and 2. A stiffening rib 32 is formed on the concave surface of the opposite side, and a cylindrical coil spring receiving portion 33 is arranged with a threshold interval at a suitable position on the concave surface. In FIGS. 1 and 2, the coil spring receiving portion 33 is formed near both ends of the movable knife pressing member 31 in the length direction and in an almost central part, in each of which a coil spring 34 is received. A pressing force of the movable knife pressing member 31 is decided by an elastic force of the coil spring 34. This elastic force of the coil spring 34 can be appropriately adjusted depending on the thickness and diameter of a wire rod, and the impact resilience.

Also, the movable knife pressing member 31 is arranged at a position near the cutting edge of the straight stationary knife 13 on the movable knife 16. The position is set such that the movable knife pressing member 31 presses a position near a meshing point of the movable knife 16 with the stationary knife 13 to strongly pressed the cutting edge part 16' of the movable knife 16 to the straight stationary knife 13. The sheet 10 can be easily loaded between the cutting edge of the stationary knife 13 and the movable knife pressing member 31. Also, the movable knife 16 is inclined by the thickness of the stationary knife 13 in a direction where the cutting edge recedes, and weakly presses an end portion opposite to the cutting edge part 16' of the movable knife 16 to the housing bottom plate 11, as shown in FIG. 2.

The movable knife pressing member 31 constituted in the above manner can be made as thick as the total thickness of the driving gear 15 of the motor 14 and the first and second movable knife driving gears 17 and 18, meshing with each other, whereby the total thickness of the sheet cutter can be very compact, as shown in FIG. 2. A concave notch 35 is provided on an end surface of the movable knife pressing member 31 on the side of the first and second movable knife driving gears 17 and 18, whereby the depth of the housing can be made compact by receiving the end portion of the first and second movable knife driving gears 17 and 18 in the notch 35.

A cover 41 covers a reduction gear arranged on the lower surface of the housing bottom plate 11. On the other hand, a tapered uncut groove 43 is formed in the center of V character of the movable knife 16. That is, the uncut groove 43 is formed in the shape of a trapezoid in which it is opened on the side of the cutting edge part 16' of the movable knife 16 and narrower straightly toward the depth. And, the forward distance of the uncut groove 43 in the center of the movable knife 16 with respect to the stationary knife 13 is increased or decreased by adjusting the stroke of the movable knife 16, whereby the uncut width in the uncut groove 43 can be adjusted.

Referring to FIGS. 1 to 4, a way of how to cut the sheet by moving the movable knife 16 toward the stationary knife 13 will be described below. If the movable knife 16 is moved forward, the cutting edge part 16' of the movable knife 16 accordingly starts to mesh with the cutting edge of the straight stationary knife 13 from both ends, and moves toward the center. If the movable knife 16 advances halfway in the direction to the stationary knife 13, the left and right meshing points also move toward the center, so that the cutting edge part 16' of the movable knife 16 and the cutting edge of the straight stationary knife 13 mesh at both meshing points. Next, if the movable knife 16 advances in the direction to the stationary knife 13 up to an almost complete position, both meshing points also move roughly to the center, so that the cutting edge part 16' of the movable knife 16 and the cutting edge of the straight stationary knife 13 mesh roughly in the center.

At any stage, since the movable knife pressing member 31 is arranged at the position near the cutting edge of the straight stationary knife 13 on the movable knife 16, the movable knife pressing member 31 presses the positions near the meshing points of the movable knife 16 with the stationary knife 13, and can strongly press the cutting edge part 16' of the movable knife 16 against the straight stationary knife 13.

Accordingly, the cutting edge part 16' of the movable knife 16 is moved in contact with the cutting edge of the straight stationary knife 13 at any time, while the movable knife 16 is moved from the most backward position from the stationary knife 13 to the most forward position, whereby the sheet 10 can be cut with clean cutting section due to a light moving load.

Also, in this case, by adjusting the stroke of the movable knife 16 by means of the motor 14 installed on the lower surface of the housing bottom plate 11 and a home position detection switch 42, the forward distance of the tapered uncut groove 43 in the center of the movable knife 16 with respect to the stationary knife 13 is increased or decreased, whereby the cut-out width in the uncut groove 43 can be suitably adjusted.

Industrial Applicability

The sheet cutter of the invention can be employed for the purposes for cutting the sheet such as paper and plastic film in various printers or ticket dispensers, and preferably employed in the apparatuses such as a printer or ticket dispenser of the type in which the stencil paper or raw material sheet is continuously supplied in the form of a roll.

The invention claimed is:

1. A sheet cutter comprising:

a housing including a top plate and a bottom plate;

a stationary knife including a straight blade part formed in a straight-line shape in a longitudinal direction;

a movable knife including a cutting edge part formed in the shape of V-character, opposed to mesh with the straight blade part of said stationary knife, said movable knife being able to freely move toward or back from said stationary knife;

a movable knife pressing member for pressing said movable knife against said stationary knife, the movable knife pressing member is disposed between the movable knife and the top plate of the housing; and a movable knife driver driving said movable knife forward or backward, wherein said movable knife pressing member presses said movable knife against said stationary knife by means of compression coil springs contained inside said movable knife pressing member, wherein the movable knife pressing member includes a first surface which is in contact with said movable knife and a second surface opposite to the first surface, wherein a first coil spring receiving portion is formed on a central part of the second surface, a second coil spring receiving portion is formed on one end of the second surface in the longitudinal direction, and a third coil spring portion is formed on an opposite end of the second surface in the longitudinal direction, wherein each of the three coil spring receiving portions store a first end of the compression coil springs therein, respectively, and a second end surface of each of the compression coil springs is in contact with the top plate of the house, wherein a thickness of the compression coil springs is not more than a thickness of the movable knife pressing member, wherein the movable knife driver includes a plurality of driving gears, wherein the movable knife pressing member has a thickness which is substantially same as a total thickness of the plurality of driving gears, wherein the plurality of driving gears includes first and second movable knife driving gears for driving the movable knife, and wherein the movable knife pressing member includes a plurality of concave notches for receiving each of end portions of the first and second movable knife driving gears to keep a depth of the housing compact.

2. The sheet cutter according to claim 1, wherein said movable knife pressing member is adjacent to a sheet to be cut and also serves as a guide for the sheet.

3. The sheet cutter according to claim 1, wherein said movable knife pressing member is a wear resistant plastic molding.

* * * * *